United States Patent [19]

Johnson

[11] 4,015,444

[45] Apr. 5, 1977

[54] METHOD OF KNITTING A TWO-WAY NON-RUN VENTILATED FABRIC

[75] Inventor: Daniel W. Johnson, Cleveland, Tenn.

[73] Assignee: Amtex, Inc., Cleveland, Tenn.

[22] Filed: Feb. 6, 1976

[21] Appl. No.: 655,934

[52] U.S. Cl. ..... 66/42; 66/57; 66/132 T; 66/180; 66/169 A

[51] Int. Cl.[2] ..... D04B 9/38

[58] Field of Search ..... 66/169 A, 132 R, 132 T, 66/170, 42, 180, 171, 57

[56] References Cited

UNITED STATES PATENTS

| | | | |
|---|---|---|---|
| 770,231 | 9/1904 | Gilbert | 66/180 |
| 1,852,936 | 5/1932 | Nebel | 66/180 X |
| 2,033,647 | 3/1936 | Quinn | 66/180 X |
| 2,035,876 | 3/1936 | Gastrich | 66/180 X |
| 2,583,748 | 1/1952 | Reinstein | 66/180 X |
| 3,003,343 | 10/1961 | Alfano | 66/180 X |
| 3,901,052 | 8/1975 | Jacobsson | 66/132 T X |

*Primary Examiner*—Mervin Stein
*Assistant Examiner*—A. M. Falik
*Attorney, Agent, or Firm*—Seidel, Gonda & Goldhammer

[57] ABSTRACT

A method is disclosed for knitting a two-way non-run ventilated fabric. The fabric is knit on a circular knitting machine having 11 thread feed positions but only 9 thread feeds operative at 3 different speeds.

6 Claims, 14 Drawing Figures

FIG. 1
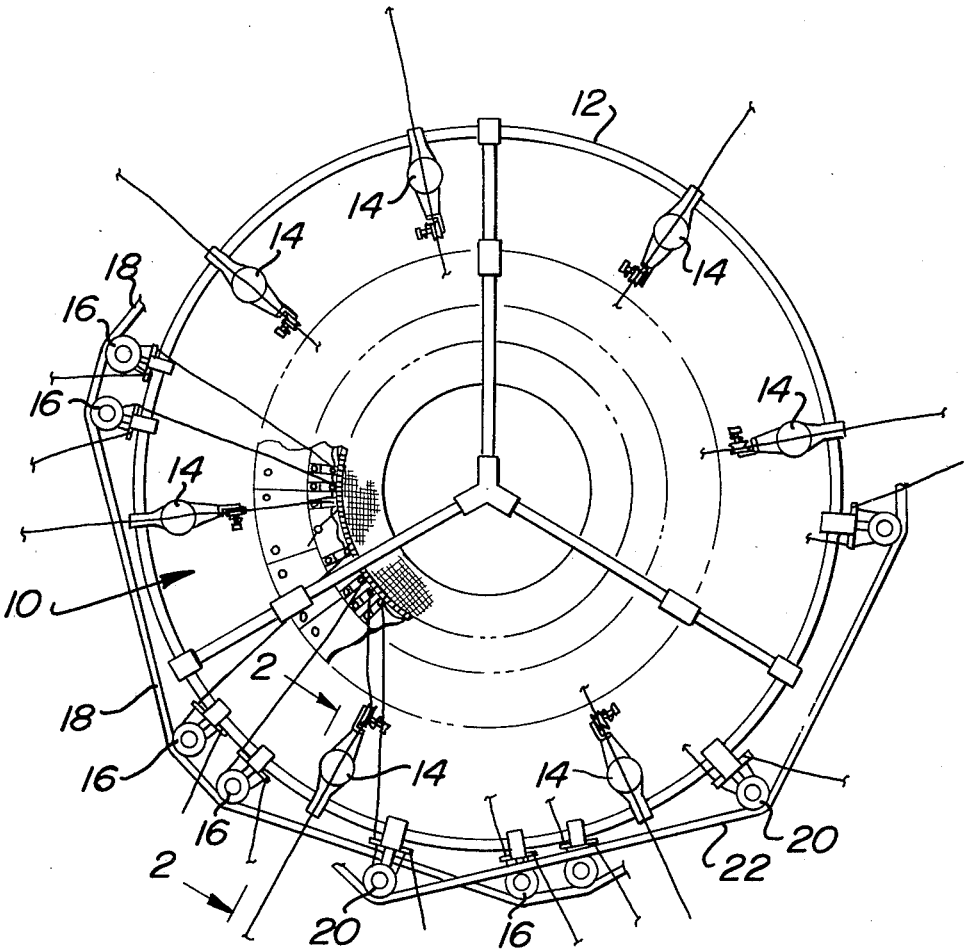
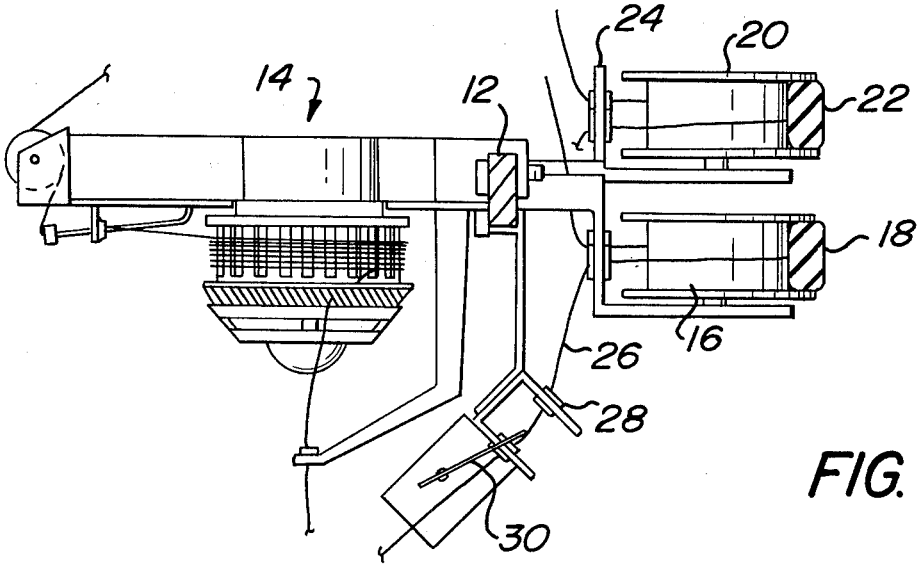
FIG. 2

FIG. 8
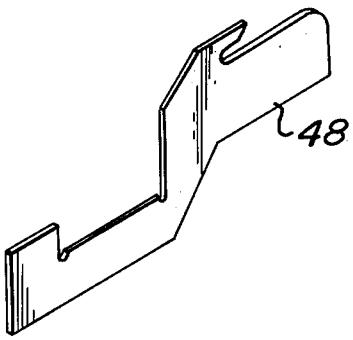
FIG. 7
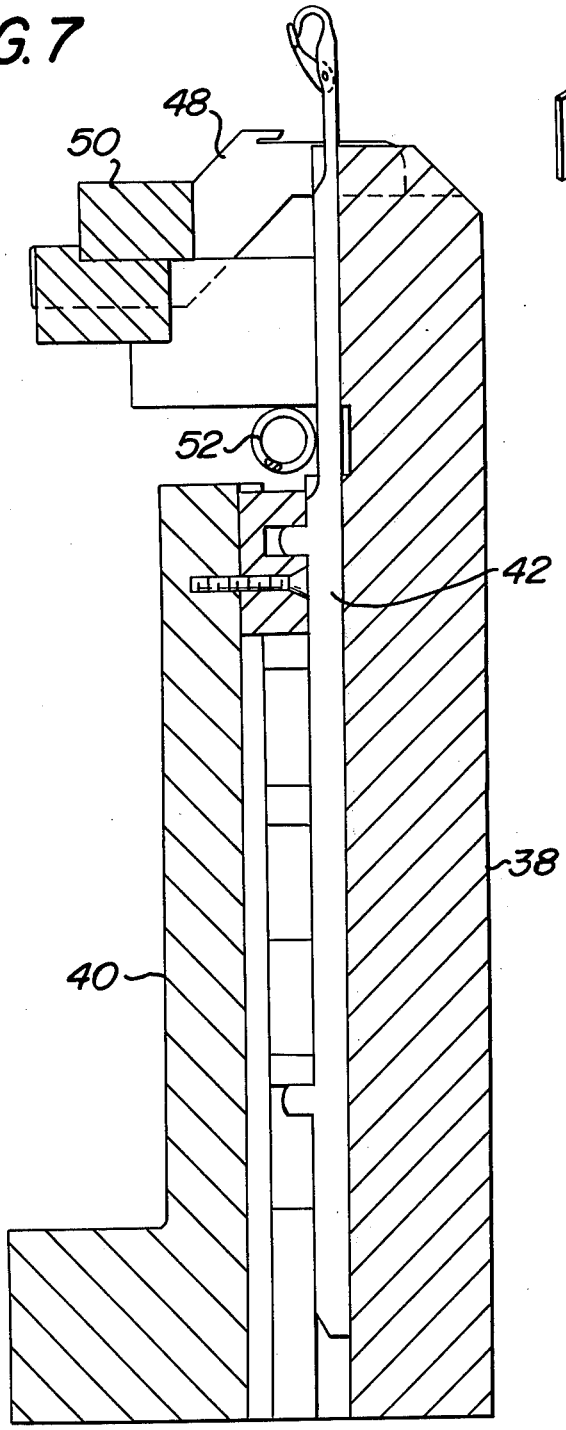
FIG. 9
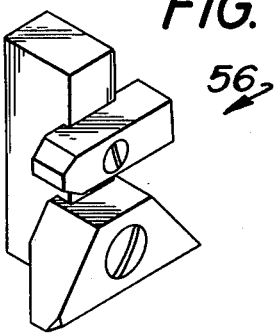
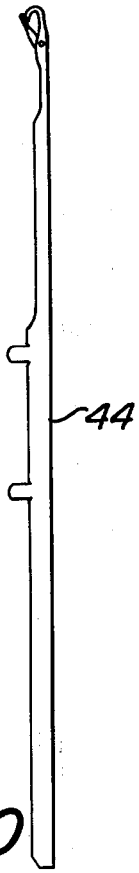
FIG. 10
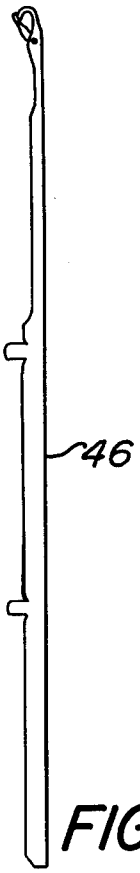
FIG. 11

FIG. 13
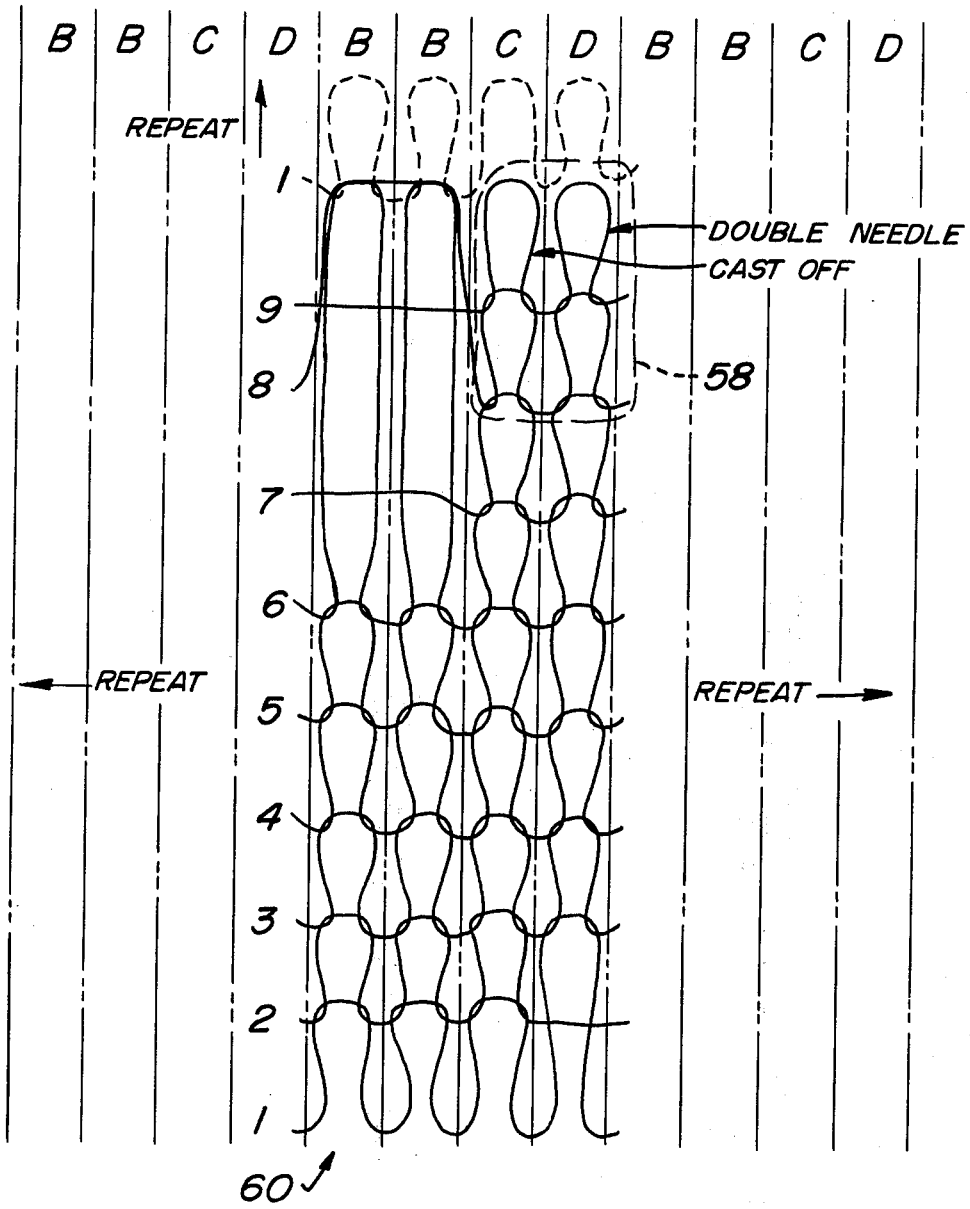
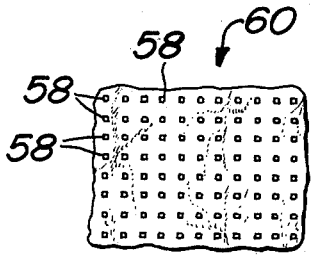
FIG. 14

METHOD OF KNITTING A TWO-WAY NON-RUN VENTILATED FABRIC

The present invention is directed to a method of knitting a ventilated fabric which is non-run in a longitudinal direction and non-run in a transverse direction. Knitting is accomplished in the form of a cylinder on a circular knitting machine. The preferred knitting machine has a large number of thread feeds, with the preferred number of thread feeds being a whole number multiple of 9 and the number of knitting positions being a whole number multiple of 11. Further, the circular knitting machine should have thread feeds which are operative at three different speeds.

Knitting is accomplished by rotating a needle carrier in the form of a cylinder about a vertical axis. The cylinder is provided with needles arranged in a repetitive set. The preferred set of needles is BBCD. As the needles rotate, they are cammed into knit, welt and tuck positions.

During the knitting of the fabric, the fastest thread feed is used when all needles of the set are in the knit position. The slowest thread feed is used when only two needles of a set are in the knit position. The intermediate thread speed is used to build up excess yarn on the C and D needles when said needles are in a knit position and the B needles are in a welt position. This provides extra fabric strength and subsequently the threads are cast off from C and D needles to create a drop stitch which in turn provides the opening in the fabric so that it is a ventilated fabric.

It is an object of the present invention to provide a method for knitting a ventilated fabric in cylindrical form on a circular knitting machine so that the fabric is non-run in a longitudinal direction and in a transverse direction.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of the circular knitting machine used to practice the present invention.

FIG. 2 is a sectional view taken along the line 2—2 in FIG. 1 but on an enlarged scale.

FIG. 7 is a sectional view taken along the line 7—7 in FIG. 6.

FIG. 8 is a perspective view of a sinker.

FIG. 9 is a perspective view of the carry-over cam.

FIG. 10 is an elevation view of a B needle.

FIG. 11 is an elevation view of a C needle.

FIG. 13 is an enlarged illustration of the fabric produced by the method of the present invention.

FIG. 14 is a plan view of the fabric produced by this invention.

Figure 3:
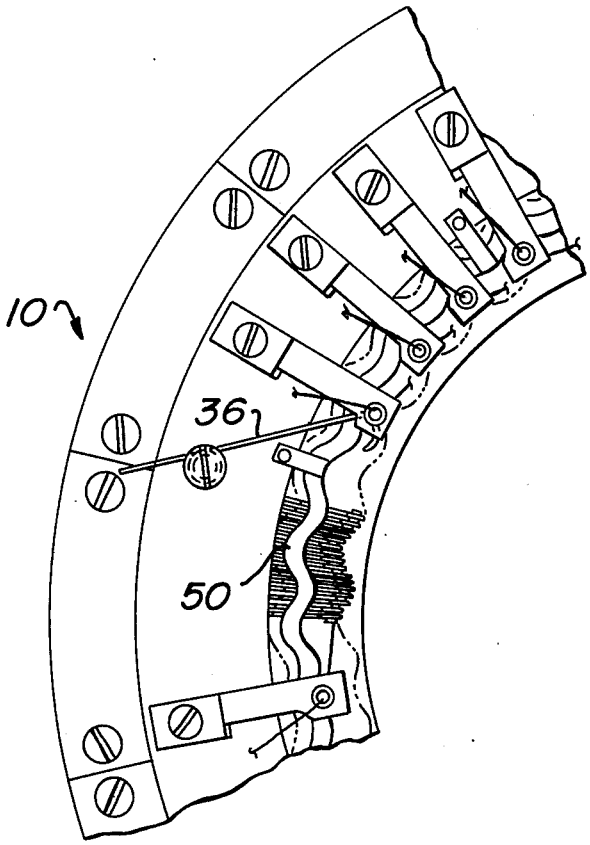
FIG. 3 is a partial plan view of the top of the knitting machine on an enlarged scale.

Referring to the drawing in detail, wherein like numerals indicate like elements, there is shown in FIG. 1 a circular knitting machine 10 provided with a frame 12 thereabove. Except as will be made clear hereinafter, the circular knitting machine 10 may be a conventional Monarch machine.

The frame 12 is likewise circular and supports a plurality of discrete motor driven storage feeders 14. As shown in FIG. 1, there are seven storage feeders. The storage feeders per se are well known to those skilled in the art and commercially available. The frame 12 also supports a plurality of high speed thread feeds 16 which are driven by a belt 18. The frame 12 also supports a plurality of low speed thread feeds 20 driven by a belt 22. The high and low speed threads are constructed in the same manner. Hence, only feed 16 will be described.

As shown more clearly in FIG. 2, a bracket 24 is mounted on the frame 12 and rotatably supports a high speed thread feed 16 driven by a separate belt 18. A thread 26 is fed through an eye on the bracket 24, around the cylindrical surface on the thread feed 16, into contact with a portion of the inner peripheral surface of the belt 18, out through another eye on the bracket 24, and then through an eye 28 to the safety switch 30. A safety switch 30 is provided at every feed position to stop the machine 10 when there is an absence of a thread. A thread may be absent due to the fact that it is broken or the machine is improperly set up by the operator.

Figure 4:
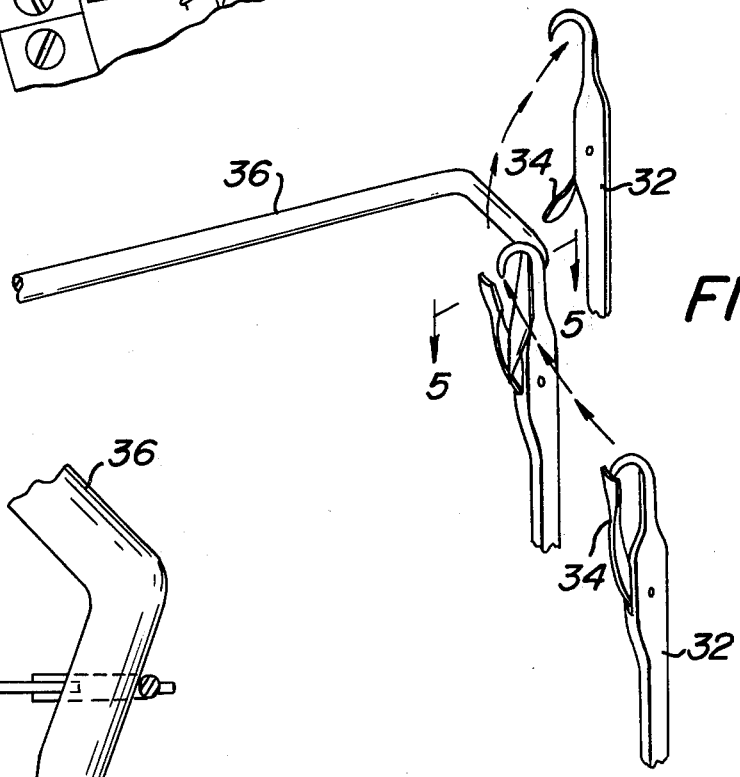
FIG. 4 is a perspective view showing unlatching of needles.
Figure 5:
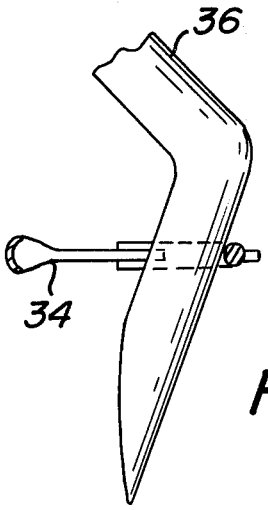
FIG. 5 is a sectional view taken along the line 5—5 of FIG. 4.

The machine 10 is provided with latch openers at spaced predetermined points thereon. FIGS. 3–5 illustrate the manner in which needles 32 are provided with latches 34 for cooperation with the latch opener 36.

A rotating needle carrier or cylinder 38 supports a large number of vertically disposed needles arranged in a predetermined repetitive pattern. A typical Monarch machine will support 2232 needles. A plurality of cam supports 40 are provided around the periphery of the cylinder 38 to cam the needles into various positions. The needles are preferably arranged in a set of BBCD. This set is repeated in that sequence. Knitting needles are standardized to the extent that anyone skilled in the art knows the difference between a B, C or D needle. A D needle 42 is shown in FIG. 7, a B needle 44 is shown in FIG. 10 and a C needle 46 is shown in FIG. 11.

Figure 6:
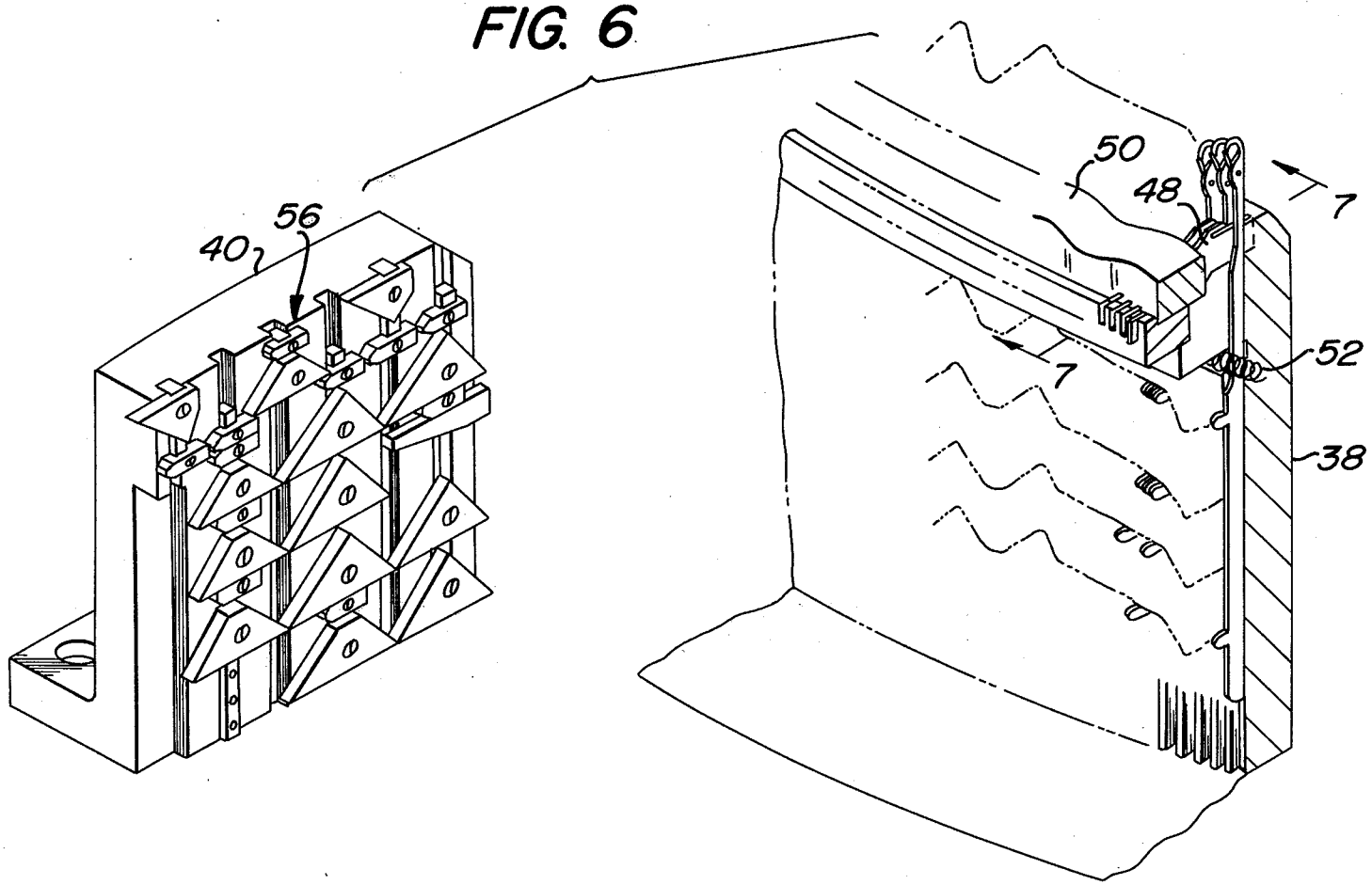
FIG. 6 is an exploded view of the cam support associated with a portion of the rotating needle carrier.

The sinkers 48 are used to cam the fabric into the center of the machine 10 where the knitted material is then wrapped onto a roller. The sinkers 48 are controlled by the cam track 50. A coil spring 52 to support the needles is provided adjacent the outer periphery of the needles above the cam support 40. See FIGS. 6 and 7.

The support 40 includes conventional knit, tuck, and welt cams, and a carryover cam 56 as shown in FIG. 9. The purpose of the carryover cam 56 is to hold the needles in a tuck position so that the latches can be opened by the latch opener 36. The carryover cam 56 is located between the end of one knitting sequence and the first position of the repeat pattern in order to set the latch opener 36 close enough to the yarn carrier to prevent the needle latches from closing and thereby allowing the needles to pick up yarn at the first position at the pattern repeat.

The needles BBCD perform the basic functions of knit, welt and tuck as they rotate with the cylinder 38 and contact the cams on the supports 40. There are 11 knitting positions. Threads are not fed at two of those 11 positions. Hence, there are only nine thread feeds for each set of BBCD needles. As pointed out above, the nine thread feeds involve feeding the threads at three different speeds. In the nine positions where there is a thread feed, five of the feeds are at high speed from the high speed feed 16, three threads are fed at low speed from the low speed feed 20, and the remaining thread feed at an intermediate speed is from the storage feeder 14.

Figure 12:
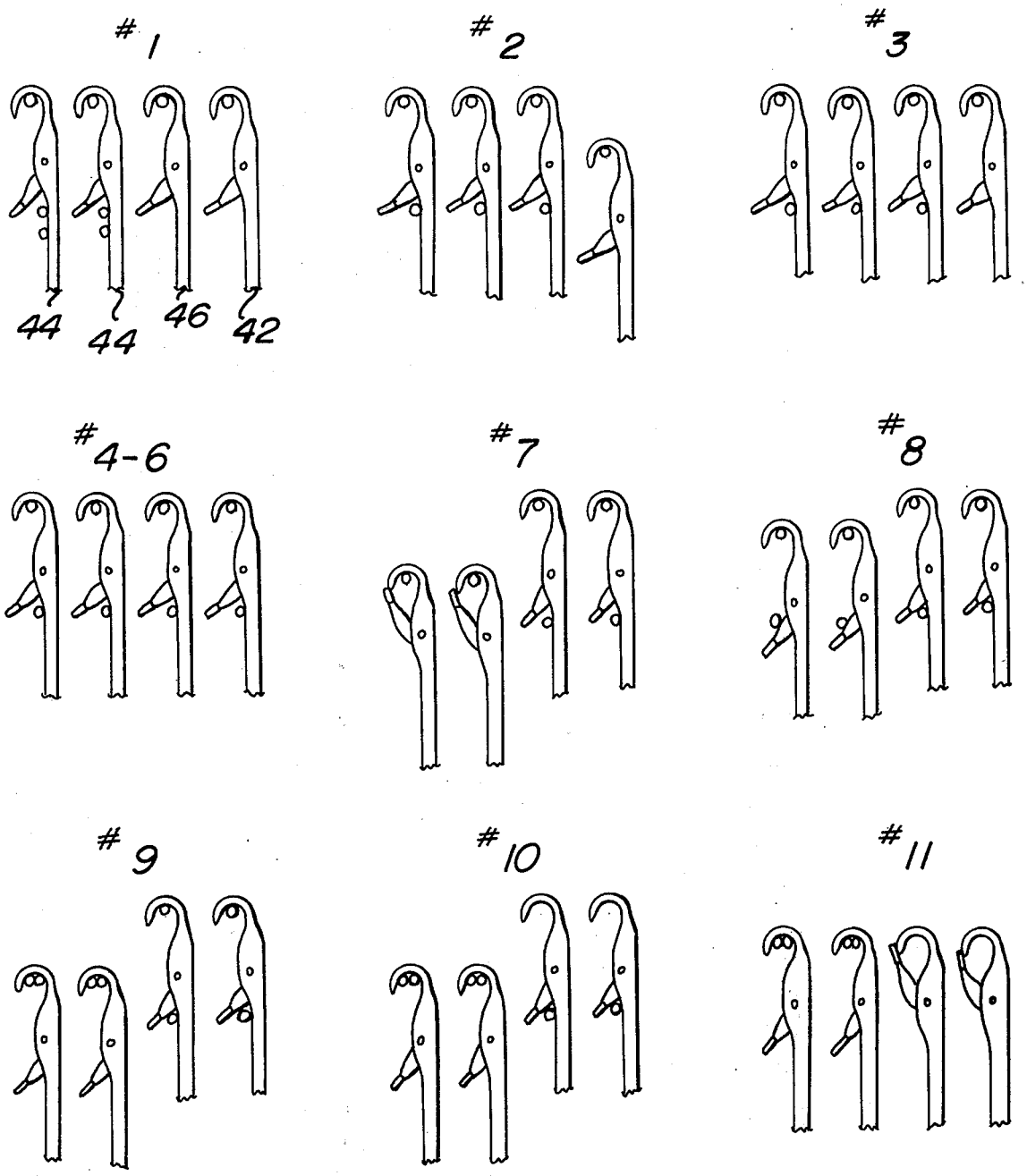
FIG. 12 is a diagrammatic sketch of eleven knitting positions.

The nine positions involving a thread feed and the two non-feed positions are sequentially shown in FIG. 12. Referring to FIG. 12, in knitting position No. 1, all of the needles are raised to a knit position where thread is fed into the needles. The B needles have thread in the hook of the needle while the C and D needles are empty and at this position pick up thread from the low speed feed 20.

Referring to FIG. 12, in knitting position No. 2, the B and C needles remain in a knit position and develop a knit stitch. The D needle is held in a welt position so that it does not pick up or release thread. The objective in holding the D needle in the welt position is so that it separates the thread on the C and D needles to thereby develop a knit stitch. In knitting position No. 2, C & D needles can perform their functions interchangeably. In knitting position No. 2, thread is fed from the low speed feed 20.

In knitting position Nos. 3–6 of FIG. 12, all needles are raised to a knit position and produce a knit stitch. Knitting positions 3–6 form the solid horizontal portion of the fabric between ventilated areas. In knitting position Nos. 3–6, thread is fed from the high speed feed 16.

In knitting position No. 7, the C and D needles are raised to a knit position and knit. The B needles are in a welt position so that they do not pick up or release any thread. The purpose of position No. 7 is to build up excess thread on the C and D needles to provide extra fabric strength and to create a non-run fabric in the longitudinal directions. In knitting position No. 7, thread is fed from low speed feed 20.

In knitting position No. 8, the C and D needles are raised to a knit position and knit. The B needles are in a tuck position and develop a tuck stitch. The tuck stitch renders the fabric non-run in a transverse direction. In knitting position No. 8, all needles pick up thread from the high speed feed 16.

In knitting position No. 9, the C and D needles are in a knit position and knit. The B needles are in a welt position. Thread is fed from the storage feeder 14 so that extra thread can be knitted by the C and D needles. The purpose of this position is to lock in the No. 8 position tuck stitch to insure a non-run fabric.

In knitting position No. 10, the C and D needles are in a knit position. The B needles are held in a welt position. No thread is fed at this position to any needles. Thus, each of the C and D needles cast off the thread loops knitted at positions 8 and 9 thereby creating an opening 58 in the knitted fabric 60.

In knitting position No. 11, all needles are in a tuck position. This prepares the needles so that they may pass through the carryover cam 56. No thread is fed at this position to any of the needles. The C and D needles have already cast off the threads knitted at positions 8 and 9 thereby creating a drop stitch to form holes 58 in the fabric 60 so that it is a ventilated fabric. After position No. 11, the above-described knitting sequence is repeated in a longitudinal direction.

In the illustrated embodiment, each sequence involves eleven positions with each sequence utilizing thread from one of the storage feeders 14. Since there are seven storage feeders around the periphery of the knitting machine 10, there are 77 transverse positions available for use with 63 thread feeds. The subject fabric can be made with as small as eleven thread feed positions and could be a whole number multiple of 11. The threads used may be natural or synthetic or a combination thereof.

The present invention may be embodied in other specific forms without departing from the spirit or essential attributes thereof and, accordingly, reference should be made to the appended claims, rather than to the foregoing specification as indicating the scope of the invention.

I claim:

1. A method of knitting a ventilated fabric which is non-run in a longitudinal direction and in a transverse direction comprising the steps of:

a. knitting said fabric in the form of a cylinder on a circular knitting machine wherein the number of thread feeds is a whole number multiple of nine operative at three different speeds, and the number of knitting positions being a whole number multiple of 11 so as to have two terminal knitting positions which lack a thread feed, said knitting step including rotating a needle carrier cylinder about a vertical axis, providing the needle carrier cylinder with needles arranged in a repetitive set of four needles, b. camming the needles into knit, welt and tuck positions as they rotate about said axis, c. using the intermediate thread speed to build up excess thread on the last two needles of each set of four needles when they are in a knit position and the other two needles of that set when they are in a welt position to provide extra fabric strength, and subsequently casting off the thread from the two needles on which excess yarn was built up to create a drop stitch.

2. A method in accordance with claim 1 wherein the needles of a repetitive set are BBCD needles in that order.

3. A method in accordance with claim 2 including controlling the needles of a set by a carryover cam located between the last knitting position and the first position of a repeat of the pattern, using the carryover cam to hold the needles in a tuck position so that latches can be opened by a latch opener.

4. A method in accordance with claim 3 wherein thread at the intermediate speed is fed from a storage feeder.

5. A method of knitting a ventilated fabric which is non-run in a longitudinal direction and in a transverse direction comprising knitting fabric in tubular form on a circular knitting machine having at least 11 feed positions and capable of feeding threads at different speeds, said knitting step including rotating a needle carrier about a vertical axis, providing the needle carrier with needles arranged in a repetitive set of BBCD needles, camming the needles into knit and welt positions as they rotate about said axis, feeding thread at a low speed directly from a storage feeder to build up excess yarn on the C and D needles when they are in a knit position and the B needles are in welt position, casting off the thread of the C and D needles to create a drop stitch which provides the holes in the ventilated fabric, and passing all needles of a set through a carryover cam while in a tuck position to repeat the knitting sequence.

6. A method in accordance with claim 5 including using thread feeds in a number which is a whole number multiple of 9, and each group of nine feeds being part of 11 knitting positions, the last two of which have no thread feed.

* * * * *